United States Patent [19]

Jaffe et al.

[11] 4,339,835

[45] Jul. 20, 1982

[54] SLEEPING SACK

[76] Inventors: Fern Jaffe, 6 W. 77th St., New York, N.Y. 10024; Rose Blacker, 429 71st St., North Bergen, N.J. 07047

[21] Appl. No.: 131,638

[22] Filed: Mar. 19, 1980

[51] Int. Cl.[3] ..... A47G 9/08

[52] U.S. Cl. ..... 5/413; 5/485; 5/498; 5/501; 5/502; 2/69.5

[58] Field of Search ..... 6/413, 416, 471, 482, 6/485, 486, 488, 494, 497, 500, 502, 501; 2/69.5

[56] References Cited

U.S. PATENT DOCUMENTS

| | | | |
|---|---|---|---|
| 2,379,416 | 7/1945 | Clark . | |
| 2,449,758 | 9/1948 | Wikmark . | |
| 2,498,055 | 2/1950 | Veit . | |
| 2,525,713 | 10/1950 | North . | |
| 2,972,757 | 2/1961 | Adrian . | |
| 3,514,796 | 6/1970 | Dibrell . | |
| 3,521,309 | 7/1970 | Evans . | |
| 3,564,629 | 2/1971 | Rogius | 2/69.5 |
| 3,859,678 | 1/1975 | Davis | 5/500 |
| 4,014,055 | 3/1977 | Torres | 5/485 |
| 4,079,472 | 3/1978 | Maguire . | |
| 4,087,874 | 5/1978 | Callaway et al. | 5/413 |
| 4,128,908 | 12/1978 | Kerbs | 5/495 |
| 4,292,700 | 10/1981 | Markel | 5/413 |

FOREIGN PATENT DOCUMENTS

| | | | |
|---|---|---|---|
| 1947683 | 4/1971 | Fed. Rep. of Germany | 5/471 |
| 2239969 | 3/1975 | France . | |
| 369169 | 3/1932 | United Kingdom . | |
| 702513 | 1/1954 | United Kingdom . | |

*Primary Examiner*—Alexander Grosz

*Attorney, Agent, or Firm*—Frishauf, Holtz, Goodman & Woodward

[57] ABSTRACT

A combination sleeping sack and decorative cover comprises an outer sack or covering which removably receives an inner sack or liner therein. The inner sack or liner completely covers the inner portions of the outer sack to prevent the outer sack from being soiled in use, the inner sack being completely removable for easy laundering. One or more pillows are retained in respective pouches of the inner and outer sacks. Access openings are provided at the bottom of the outer sack to facilitate insertion of the inner sack and to permit securing of the inner and outer sacks together.

11 Claims, 12 Drawing Figures

FIG. 1
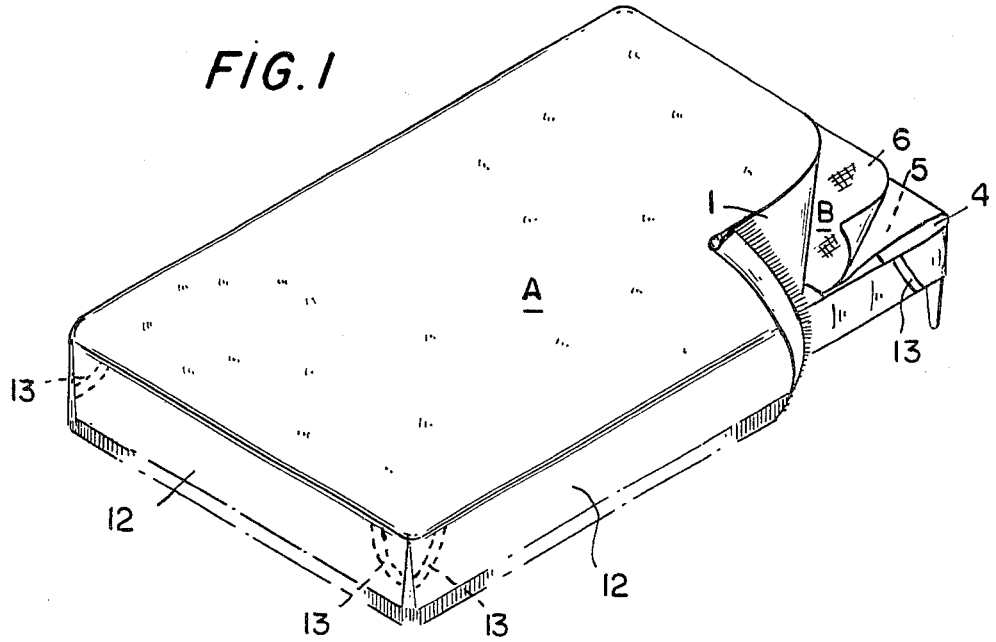
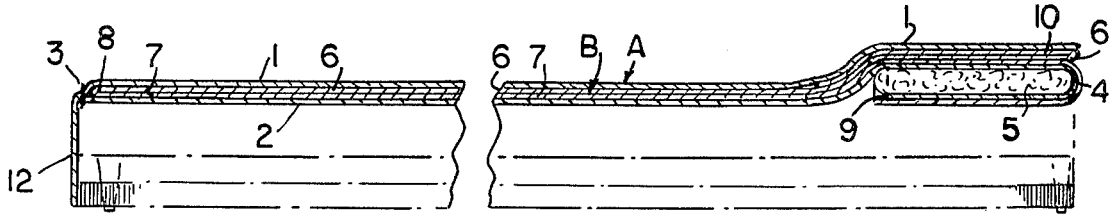
FIG. 2
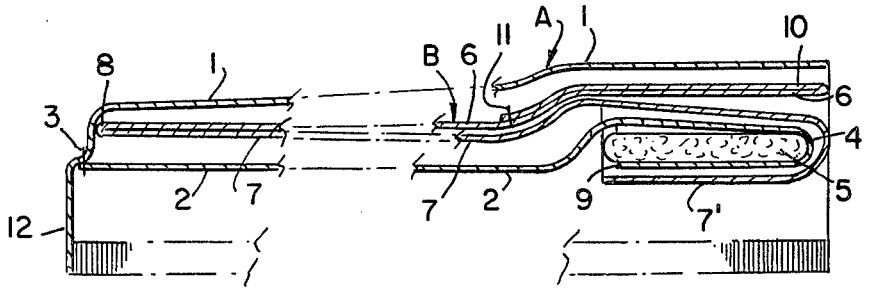
FIG. 3

FIG. 4
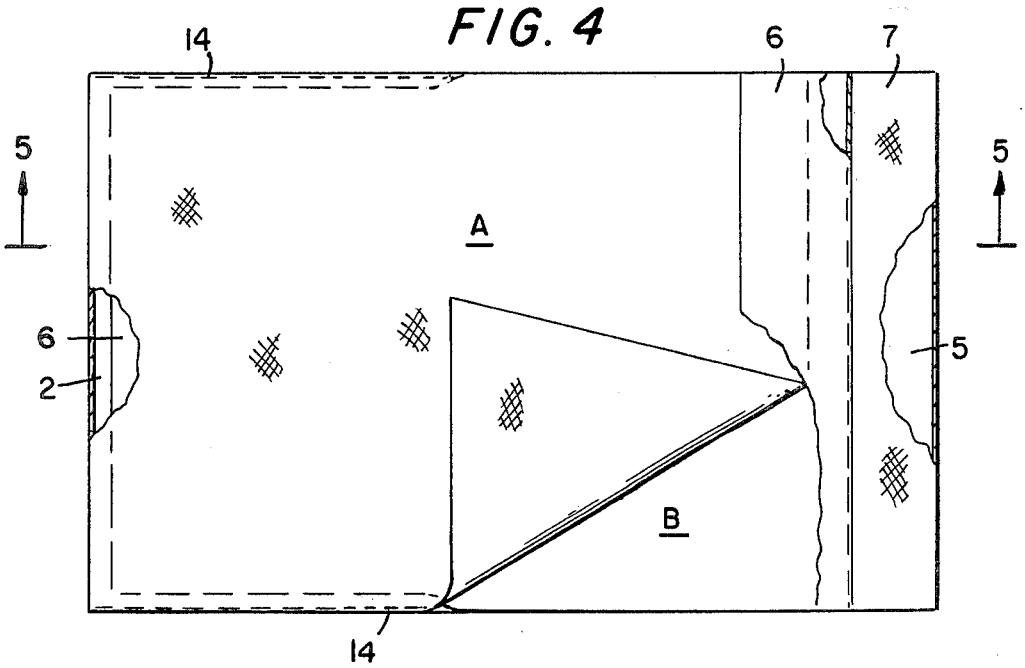
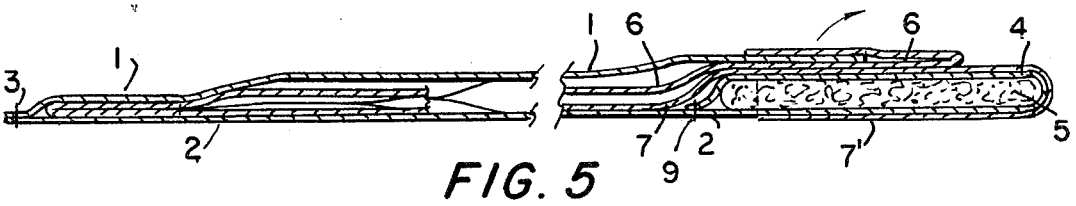
FIG. 5
FIG. 6
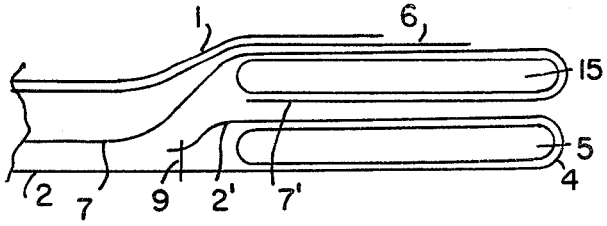
FIG. 7
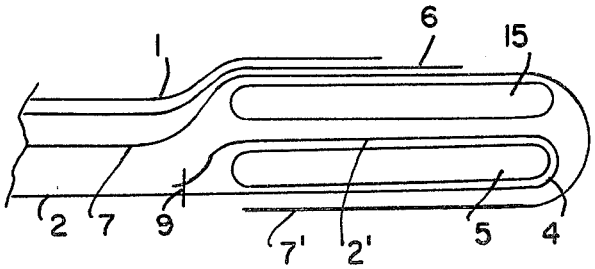

SLEEPING SACK

BACKGROUND OF THE INVENTION

This invention relates to a combination sleeping sack and bedspread, and more particularly to such a combination sleeping sack and bedspread which has a removable inner liner and which is improved so that the removable inner liner is more easily insertable and positively retained in position.

Prior art sleeping bags or sacks are exemplified, for example, in U.S. Pat. Nos. 4,079,472 and 4,014,055. The arrangements of these patents have disadvantages in that they are not readily and easily assembled for use and where an inner liner is utilized, the inner liner is difficult to insert and is not positively retained in position.

The object of the present invention is to provide an improved combination sleeping sack and bedspread which is attractive, easy to fabricate, easy to assemble and which includes positive retention means so as to facilitate assembly and changing of the inner liner and to maintain the sleeping sack in a neat condition, even during use.

SUMMARY OF THE INVENTION

According to the present invention, a sleeping sack arrangement comprises an outer sack having a lower layer and an upper layer secured to the lower layer at the foot end of the sleeping sack and at least along a portion of the sides of the sleeping sack, the outer sack further comprising means for retaining a pillow member at the head end of the sleeping sack; and an inner sack removably received between the inner and outer layers of the outer sack, the inner sack comprising an upper layer and a lower layer, the upper and lower layers of the inner sack being secured together along the foot ends of the inner sack and at least along a portion of the sides of the inner sack, the inner sack further comprising means for substantially enclosing and covering the pillow retaining means of the outer sack.

Means is preferably provided for releasably securing the inner and outer sacks together at least in the vicinity of the foot end of the sleeping sack, and/or access openings are provided at the foot end of the outer sack for inserting a hand to facilitate assembly.

BRIEF DESCRIPTION OF THE DRAWINGS

FIG. 1 is a perspective view showing the combination sleeping sack and bedspread of the present invention installed on a bed, with the various layers thereof peeled back from one corner;

FIG. 2 is a cross-sectional view of the arrangement of FIG. 1;

FIG. 3 is an expanded sectional view, with the layers separated, of an embodiment of the invention;

FIG. 4 is a top view of an embodiment of the invention, parts thereof being shown broken away and in sections;

FIG. 5 is a cross-sectional view of the embodiment of FIG. 4 taken along the line V—V;

FIGS. 6 and 7 illustrate modified arrangements of the present invention;

DETAILED DESCRIPTION

Figure 8:
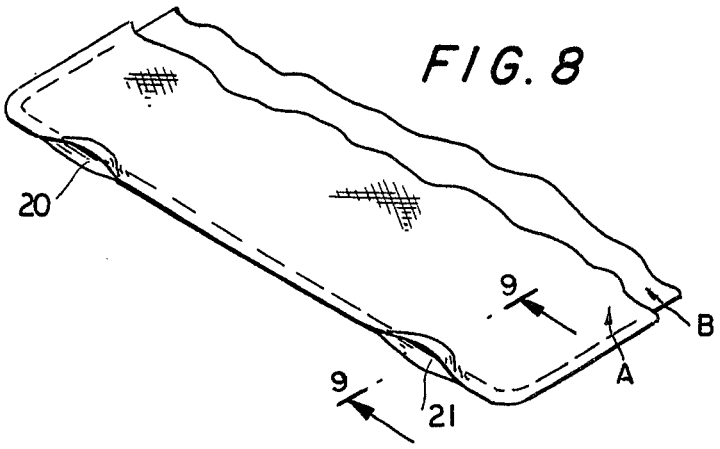
FIG. 8 is a partial view showing access openings for securing the elements together, in accordance with the invention.

FIGS. 1–3 illustrate a combination sleeping sack and decorative cover or bedspread according to the present invention, hereinafter referred to only as "sleeping sack" for convenience. The sleeping sack comprises an outer decorative sack or covering A and an inner sack or liner B removably received therein. The outer covering A is in the form of a sack and comprises an outer layer 1 and an inner or lower layer 2 (see FIGS. 2 and 3), the inner and outer layers 1, 2 being stitched together, for example, at the "foot end" 3 to form an open-ended sack which is open toward the right hand side (head end) in FIGS. 1–3. The inner or lower layer 2 of the outer covering A is cut longer and is folded over at the head end to form a pillow receiving pouch 4 at the head end thereof for retaining a pillow 5 therein. The pillow pouch 4 may be closed at the opposite sides thereof and open across the width of the sleeping sack for receiving a pillow 5 therein from the underside of lower layer 2, or may be open at at least one side and stitched across the width as diagrammatically shown by stitches 9 in FIGS. 2 and 3 for receiving a pillow 5 from the sides.

A removable liner or inner sack B of the invention comprises an upper layer 6 and a lower layer 7 which are seamed or otherwise connected together at 8 on the left-hand or foot end of the sleeping sack so as to form a pouch-type liner. The upper and lower liner layers 6, 7 are preferably integral and are folded over on each other as best seen in FIG. 3. The lower liner layer 7 folds back on itself at the head end to form a pouch 7' which covers the pillow 5 and pouch 4 of the outer covering, as best seen in FIGS. 2 and 3. The sides of pouch 7' are preferably seamed together so as to easily slip over the pouch 4 and pillow 5.

The upper layer 6 of the liner or inner sack B is folded back on itself at the head end, for example as seen in FIG. 3, the folded back portion 10 being stitched to the layer 6 at 11. The folded back portion 10 adds some "body" to the assembly and creates a more finished appearance. The outer covering or decorative sack portion A has extended sides and bottom portions 12 to create a "bedspread" effect. The unit may be secured to a mattress by, for example, diagonally oriented elastic strips 13 at each corner, the elastic strip 13 being secured to the sleeping sack and extending under the mattress. Alternatively, the sleeping sack may have contoured corner portions which engage the corners of the mattress. The illustrated embodiment includes extended side and end portions 12. However, the removable liner or inner sack B preferably does not have such extended sides or end portions. As seen in FIG. 4, the sides of the outer sack A are stitched (securing the upper and lower layers 1, 2 together, along the sides, for example by stitching 14, to provide a receptacle for receiving the inner sack B. It should be clear that the side and end extensions 12 may be eliminated so that the resulting structure looks as shown in FIG. 4. Without the side and end extensions 12, the unit is more in the nature of a sleeping bag to be placed on top of a bed, bunk, couch, on the floor, etc. When not in use, it can be easily rolled up and put away.

The embodiment shown in FIG. 4, and shown in cross-section in FIG. 5, is similar to the embodiment of FIGS. 1–3 except that the extensions 12 are eliminated, and except that the length of the upper layer 1 of the outer sack A is shortened so that a lengthened outer layer 6 of the inner liner or sack B can be folded therearound. This arrangement provides more sanitary protection for the outer sack A and prevents it from being soiled in use. Preferably, as illustrated in FIG. 4, the outer sack A has its upper and lower layers 1, 2 stitched together along the sides (stitches 14) for approximately one-half the length thereof. This permits the upper layer 1 of the outer sack A to be folded back, as shown in FIG. 4, for easier insertion of the liner B therein. Also, the upper and lower layers 6, 7 of the inner sack B are stitched together along their sides (similar to stitching 14) for about one-half the length thereof, the upper or head end being not-connected together. Thus, when a user enters the sleeping sack, the layers 1 and 6 can be swung open together, in a manner similar to that shown in FIG. 4, to permit easy access.

FIGS. 6 and 7 illustrate, in line drawings, features of the invention which permit a great deal of flexibility in arrangement and comfort to the user. For example, FIG. 6 illustrates one method to arrange the configuration with two pillows 5, 15, one pillow 5 being retained within pouch 4 (as shown in FIGS. 1–5) and a second pillow 15 being retained within the pouch formed by turned over lower layer 7 of the inner liner B. In this manner, the arrangement is still secure and one or two pillows can be used, as desired. The embodiment of FIG. 7 is a further modified arrangement wherein two pillows 5, 15 are used, one pillow 5 being retained in pouch 4, and a second pillow 15 being located above pouch 4, both pillows 5 and 15 being retained in a large pouch formed by turned back layer 7'.

In the embodiments of FIGS. 5–7, it is noted that the pouch 4 is formed by turning the lower layer 2 of the outer sack A inwardly, rather than outwardly as shown in FIGS. 2 and 3. The particular manner in which the pouch 4 is formed is not critical. For example, the pouch may be formed by a separate layer stitched in position, in place of the turned back portion 2' of lower layer 2 (see FIGS. 6 and 7).

Figure 9:
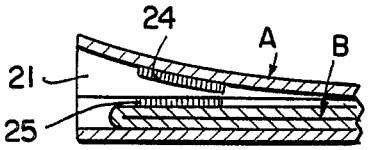
FIGS. 9–11 illustrate various interconnection techniques in accordance with the present invention.
Figure 10:
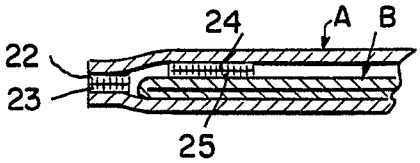
Figure 11:
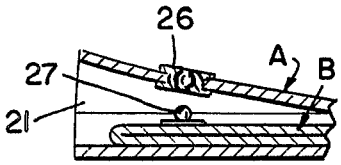
Figure 12:
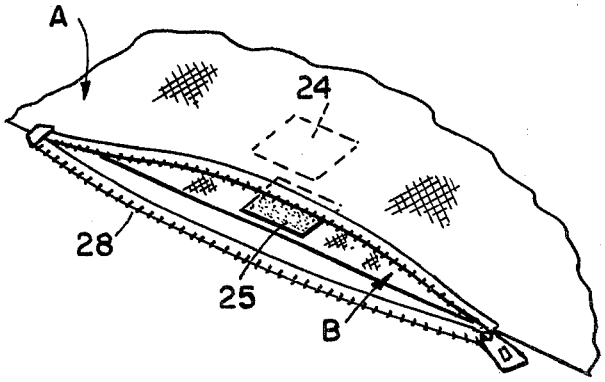
FIG. 12 illustrates a modified arrangement using a zipper-opening in combination with an anchoring means according to the present invention.

Referring to FIG. 8, at the foot of the outer sack are formed two openings 20, 21 which are large enough to permit a hand to be inserted therein. When the inner sheet or liner sack B is inserted in the outer sack A, it can be pulled into place quickly and easily by inserting the hands through the openings 20, 21 in the outer sack A. If the openings 20, 21 are placed in the vicinity of the corners, it is easy to properly arrange the two sacks relative to each other in a simple and expedient manner. Attachment members, such as strips 22, 23, made of hook and loop type fastener such as the ones sold under the trademark of Velco can be provided as shown in FIG. 10 to close the openings 20, 21. Moreover, strips 24, 25 can be attached to the inner and outer sacks, respectively, to secure the inner sack B to the outer sack A, for example as shown in FIGS. 9 and 10. In this manner, not only are the openings 20, 21 closed to keep the appearance neat, but the inner and outer sacks are securely retained in place and together. Snaps or ties can be substituted for the fasteners, FIG. 11 showing the use of a snap device 26, 27. Additional snaps similar to snap 26, 27 can be used to close the respective openings 20, 21 or appropriate ties could be used. Still further, as shown in FIG. 12 a zipper 28 can be used to close the openings 20, 21 at the foot of the outer sack A. Preferably, small openings 20, 21 are provided in the vicinity of the corners of the sleeping sack. The openings 20, 21 may be provided in the sides of the outer sack A, rather than at the foot, as desired. Still further, one continuous opening could be provided at the bottom of the outer sack A which effectively spans the distance between openings 20, 21. However, this arrangement is not preferred since it is more difficult to close off and will not retain as neat an appearance as the arrangement shown in FIG. 8.

The materials from which the sleeping sack of the invention are made can be varied. For example, the inner lining is preferably made of a sheet-like cotton or other synthetic material, which is normally used for fabrication of bed sheets. The outer sack A may be made of the same bed-sheet type material on both the top and bottom, or can be made of heavier materials to provide appropriate cushioning, for example when the sleeping sack is used on a floor. The upper layer 1 of the outer sack A can be made of a blanket-type material for warmth, as desired. The pillows 5, 15 may be conventional pillows or may be permanent wedges or cushioning members which are permanently installed in the pillow pouch 4. It is preferable not to have a permanent pillow in the pouch formed by layer 7' since the liner should be preferably easily removed for laundering.

The upper layer 1 is preferably of a decorative material so that the sleeping sack presents an attractive appearance when placed on a bed and not in use, thereby taking the place of a conventional bedspread. The pouch formed by turned-back portion 7' of layer 7 is preferably large enough to permit use with one or more pillows, such as shown in FIGS. 6 and 7. While two pillows are shown in FIGS. 6 and 7, additional pillows could be used, as desired.

An advantage of the arrangement of the present invention is that the inner liner B could be made of waterproof material, or just the lower layer 7 thereof could be waterproof. The lower layer 7 of the liner could be stiffened by laminating multi-layers to provide more "body" to facilitate insertion of the inner liner and to better protect the outer sack A.

Even when the inner liner B is removed for laundering, the remaining outer sack A, with its pillow inserted in pouch 4, the sleeping sack still has a "made bed" look because the pillow is still in place and provides a puffed-up and cared for look. As should be apparent, more than one pillow may be provided end-to-end, depending upon the width of the sleeping sack.

Depending upon the width of the sleeping sack, more than two openings 20, 21 can be provided. For example, in a "queen" size sleeping sack, it is preferred to have three openings, one in the vicinity of the corners as shown in FIG. 8 and one substantially centrally located opening.

We claim:

1. A sleeping sack arrangement for use on top of a sleeping surface, and having a foot end, a head end and opposite sides extending from said foot end to said head end, comprising:

an outer sack (A) having a lower layer (2) and an upper layer (1) secured to said lower layer at the foot end of the sleeping sack and at least along a portion of the sides of said sleeping sack, said outer sack (A) further comprising operable pocket means (4) for removably retaining a pillow member (5) in said pocket means at the head end of the sleeping sack, the upper and lower layers of the outer sack being always unconnected from each other at the sides thereof at the head end portion of the outer sack to provide an opening between the upper and lower layers of the outer sack at the head end portion of the outer sack;

an inner sack (B) removably received between the inner and outer layers of said outer sack (A), and comprising an upper layer (6) and a lower layer (7), said upper and lower layers of said inner sack being secured together along the foot end of said inner sack and at least along a portion of the sides of said inner sack, said inner sack further comprising a further operable pocket means (7') at the head end portion of said inner sack for engaging and substantially enclosing and removably covering the pillow retaining means (4) of said outer sack to prevent said pillow retaining means (4) of said outer sack from being uncovered by said head end portion of said inner sack during normal use, while permitting easy intended removal of said further pocket means from said pillow retaining means (4) of said outer sack, the upper and lower layers (6, 7) of said inner sack being always unconnected from each other at the sides thereof at the head end portion of said inner sack to permit entry of user into said inner sack between the upper and lower layers of said inner sack, the inner sack being removably received in the outer sack through at least said opening at the head end portion of the outer sack;

means (24, 25; 26, 27) for releasably securing said inner and outer sacks together at least in the vicinity of the foot end of said sleeping sack;

and at least one permanently open access opening in said outer sack, in the vecinity of the foot end thereof, through which a hand is passable for facilitating insertion and arrangement of said inner sack (B) within said outer sack (A).

2. The sleeping sack of claim 1 wherein said means for releasably securing said inner and outer sacks together are located at corner portions at the foot end of said sleeping sack.

3. The sleeping sack of claim 1 further comprising means for closing a portion of said at least one access opening.

4. The sleeping sack of claim 1 comprising at least two access openings in said outer sack, each access opening being provided in the vicinity of a corner at the foot end thereof, and through which a hand is passable for facilitating insertion and arrangement of said inner sack (B) within said outer sack (A).

5. The sleeping sack of claim 4 further comprising means for closing a portion of said access openings.

6. The sleeping sack of claim 1 wherein said lower and upper layers of said outer sack are secured together for approximately one-half the length of said outer sack along the sides thereof.

7. The sleeping sack of claim 6 or claim 1, wherein said upper and lower layers of said inner sack (B) are secured together for approximately one-half the length of said inner sack along the sides of said inner sack.

8. The sleeping sack of claim 6 wherein said enclosing means (7') of said inner sack comprises a pouch with an opening therein for substantially enclosing and covering the pillow and pillow retaining means (4) of said outer sack.

9. The sleeping sack of claim 8 wherein said pouch includes means for retaining at least two pillows therein.

10. A sleeping sack arrangement comprising:

an outer sack (A) having a lower layer (2) and an upper layer (1) secured to said lower layer at the foot end of the sleeping sack and at least along a portion of the sides of said sleeping sack, said outer sack (A) further comprising means (4) for removably retaining a pillow member (5) at the head end of the sleeping sack;

an inner sack (B) removably received between the inner and outer layers of said outer sack (A), and comprising an upper layer (6) and a lower layer (7), said upper and lower layers of said inner sack being secured together along the foot end of said inner sack and at least along a portion of the sides of said inner sack, said inner sack further comprising means (7') for substantially enclosing and removably covering the pillow retaining means (4) of said outer sack;

at least two access openings in said outer sack at the foot end of said outer sack (A), said access openings being provided at least in the vicinity of each of the corners of said outer sack at the food end of said outer sack, said access openings being dimensioned such that a hand is passable therethrough to facilitate insertion and arrangement of said inner sack (B) within said outer sack (A); and means (24, 25; 26, 27) for releasably securing said inner and outer sacks together at least in the vicinity of the foot end of said sleeping sack.

11. The sleeping sack of claim 10 further comprising means for closing said access openings.

* * * * *